US005348790A

United States Patent [19]

Ben-Zvi et al.

[11] Patent Number: 5,348,790

[45] Date of Patent: Sep. 20, 1994

[54] EXTRUDED PANEL UNIT FOR CONSTRUCTIONAL PURPOSES

[75] Inventors: Nir Ben-Zvi; Shaul Givoni, both of Upper Galilee, Israel

[73] Assignee: DAN-PAL, Upper Galilee, Israel

[21] Appl. No.: 5,805

[22] Filed: Jan. 19, 1993

[30] Foreign Application Priority Data

Jan. 24, 1992 [IL] Israel ..... 100758

[51] Int. Cl.[5] ..... B32B 1/00; E04C 2/34

[52] U.S. Cl. ..... 428/178; 428/99; 428/120; 428/188; 428/192; 428/213; 428/215; 52/806

[58] Field of Search ..... 428/119, 120, 33, 99, 428/156, 172, 188, 178, 192, 213, 215, 220; 52/806, 808

[56] References Cited

U.S. PATENT DOCUMENTS 4,889,758 12/1989 Rinkewich ..... 428/178

FOREIGN PATENT DOCUMENTS 0050462 4/1982 European Pat. Off. .
1609777 4/1970 Fed. Rep. of Germany .
2212870 9/1973 Fed. Rep. of Germany .
2527013 1/1976 Fed. Rep. of Germany .
8225408 12/1982 Fed. Rep. of Germany .
676267 12/1990 Switzerland .

*Primary Examiner*—Donald J. Loney
*Attorney, Agent, or Firm*—Beveridge, DeGrandi, Weilacher & Young

[57] ABSTRACT

An extruded, panel unit for constructional purposes, having two sheet-like major surfaces interconnected and spaced apart by a plurality of ribs and intermediate surfaces dividing the space delimited by the major surfaces into a plurality of sub-spaces. In cross-section, the sheet-like major surfaces and the rib and intermediate surfaces form a truss-like structure and there are provided more than three sub-spaces across a plane extending substantially normal to and connecting the major surfaces.

14 Claims, 2 Drawing Sheets

EXTRUDED PANEL UNIT FOR CONSTRUCTIONAL PURPOSES

The present invention relates to extruded, modular panels for the construction of wall and roof sections, whether opaque or light-transmitting panels.

Plastic insulative panels are known in the art, and commonly consist of two spaced-apart extruded sheets of a plastic material constituting major surfaces of the panels, integrally connected by ribs perpendicularly or obliquely oriented with respect to the sheets, producing a plurality of air spaces of a rectangular cross section. Similarly constructed panels also include an intermediate sheet, thus forming two enclosed spaces between the major surfaces.

In Israel Patent 61314, there is also disclosed a further type of panel, wherein the ribs zigzag between the two major surfaces and are attached to them via short auxiliary ribs, which extend from the inflection points of the zigzagging main ribs to the respectively nearest one of the major surfaces. The purpose of this arrangement is to reduce to a minimum the mass of material at the point of attachment of the ribs to the major surfaces, in order to reduce heat-bridging between the two major surfaces and thus enhance the insulative properties of the panel. At the same time, these auxiliary ribs being relatively short, the structural reinforcement effect of the main ribs remains substantially unimpaired.

All of the above-described prior art panels having generally only two, or at most three, enclosed spaces, are formed with the major surface, which is adapted to face the outside, having a thickness greater than the thickness of the other major surface, for the purpose of withstanding buckling. Furthermore, in order to enhance the strength of such panels to withstand pressures, such as wind pressures applied thereupon, the areas bracketing both sides of the connection between a rib and the major surface adapted to face the outside of the structure, have a substantially thicker cross-section, projecting towards the interior of the panel. This forms arch-like spaces adjacent to the outwardly facing major surface, thereby increasing the overall cost of the extrusion head and the cost of the panel due to the added reinforcing material used, not to mention the added material and weight.

It is therefore a broad object of the present invention to ameliorate the disadvantages of the prior art panels, and to provide an extruded plastic panel unit providing an increased capability for withstanding pressures applied thereagainst, without substantially increasing the thickness of the major surfaces, as well as the thickness of internal ribs and surfaces.

It is a further object of the present invention to provide an extruded, modular panel having a thermal insulating capability, which is superior to the capability of the prior art panels having the same thickness, and containing an equal amount of material.

In accordance with the present invention there is therefore provided an extruded panel unit for constructional purposes, comprising at least two sheet-like major surfaces interconnected and spaced apart by a plurality of ribs and intermediate surfaces dividing the space delimited by said major surfaces into a plurality of sub-spaces, wherein, in cross-section, said sheet-like major surfaces and said rib and intermediate surfaces form a truss-like structure and wherein there are provided more than three sub-spaces across a plane extending substantially normal to and connecting said major surfaces.

In addition to the thermal advantages gained by using a panel constructed in accordance with the present invention as will be shown in greater detail hereinafter, it can be shown that the resistance to buckling of the subject panel can be expressed, as follows:

$$\sigma = f\left[\left(\frac{b}{l}\right)^2\right],$$

$\sigma$ is the critical stress;

b is the thickness of the ribs or surfaces of the panel, and l is the distance between two adjacent ribs or surfaces.

Further development of this equation leads to the conclusion that in order for the panel to be capable of withstanding a certain given force applied thereagainst, as there will be formed more ribs and surfaces in the space between the two major surfaces, thus forming more sub-spaces, the ribs and surfaces may be made thinner, and hence the overall amount of material used and the weight of the panel, is decreased.

The invention will now be described in connection with certain preferred embodiments with reference to the following illustrative figures, so that it may be more fully understood.

With reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
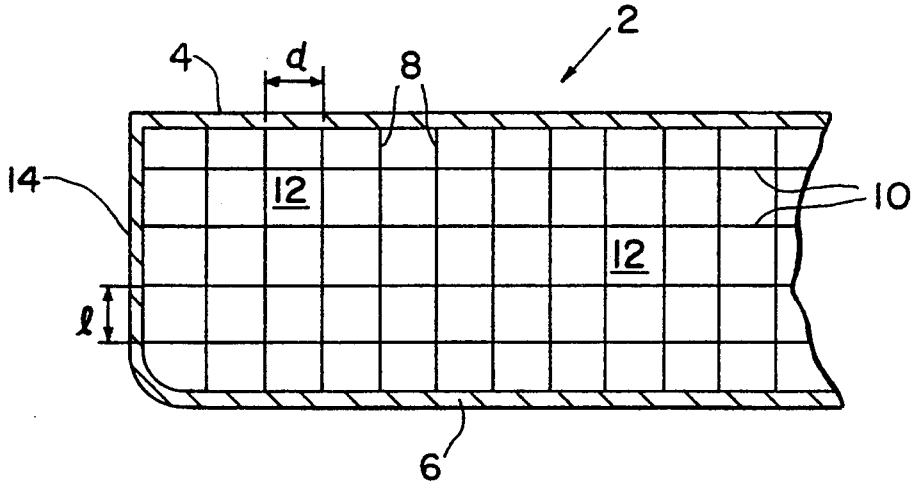
FIG. 1 is a partial cross-sectional view of the panel according to the invention.

There is seen in FIG. 1 a cross-sectional view of a preferred embodiment of a portion of a modular, plastic panel unit 2 according to the invention, including two sheet-like major surfaces 4 and 6 interconnected and spaced-apart by a plurality of ribs 8 extending in a direction substantially perpendicular to the two surfaces 4 and 6. The ribs are joined by intermediate surfaces 10, extending in a direction substantially parallel to the major surfaces, so as to form together with the ribs a plurality of sub-spaces 12. In the shown example there are formed five sub-spaces 12 in between the two major surfaces, however, for achieving the advantages gained by this structure, on the one hand, three or four such spaces are sufficient, and, on the other hand, there may be formed more than five spaces. Advantageously, the distances between adjacent ribs and surfaces are substantially equal so as to form, in cross-section, a configuration of squares.

Further seen in FIG. 1 is an optional end wall 14, which may be coextruded with at least one of the two major surfaces 4 and 6, the ribs 8 and the surfaces 10. As explained hereinbefore, the major surface 4 intended to be disposed toward the outside, is advantageously made slightly thicker (e.g., 0.5–0.8 mm) than the second opposite major surface 6 and side wall 14 (e.g. 0.4–0.6 mm). The ribs 8 and surfaces 10 are made of much thinner material (e.g., 0.1 mm).

A panel constructed as above provides the advantage of increasing the thermal insulation as compared with a prior art panel having the same overall dimensions. The division of the space between the major surfaces into a plurality of smaller sub-spaces of decreased height, allows a decrease in the thickness of the surfaces and ribs, thereby obtaining a reduction in the quantity of material used, an improvement of thermal capability and an improvement in resistance against buckling.

The latter feature concerning resistance against buckling is particularly important with bent or curved panels, wherein there are applied stretching forces on one of the major surfaces and compressing forces on the opposite major surface. Compression of one of the surfaces causes the forming of ripples or corrugations therealong, resulting in optical disturbances, or at least irregularities, in the panel, which greatly detracts from the aesthetic appearance of the product. Such ripples or corrugations are not formed or, at least, reduced to a tolerable extent, with the panels of the present invention, wherein reinforcing ribs are in close spaced-apart relationship from each other along the major surfaces. It has been established that a distance of between 2.5 and 7.5 mm between adjacent ribs 8, and for that matter, also between adjacent surfaces 10, provide satisfactory results. The provision of closely spaced-apart ribs also enables a reduction in the thickness of the outside facing surfaces 4 and 6, without causing a reduction in buckling resistance.

In general, it was found that good results are obtained when the relationship between the distance, d, between two adjacent ribs and the distance, 1, between two adjacent surfaces of a sub-space formed thereby, should be such that:

$$d/1 \leqq N/2,$$

where N is the number of subspaces between the two major surfaces, and when $N \geqq 4$.

Figure 2:
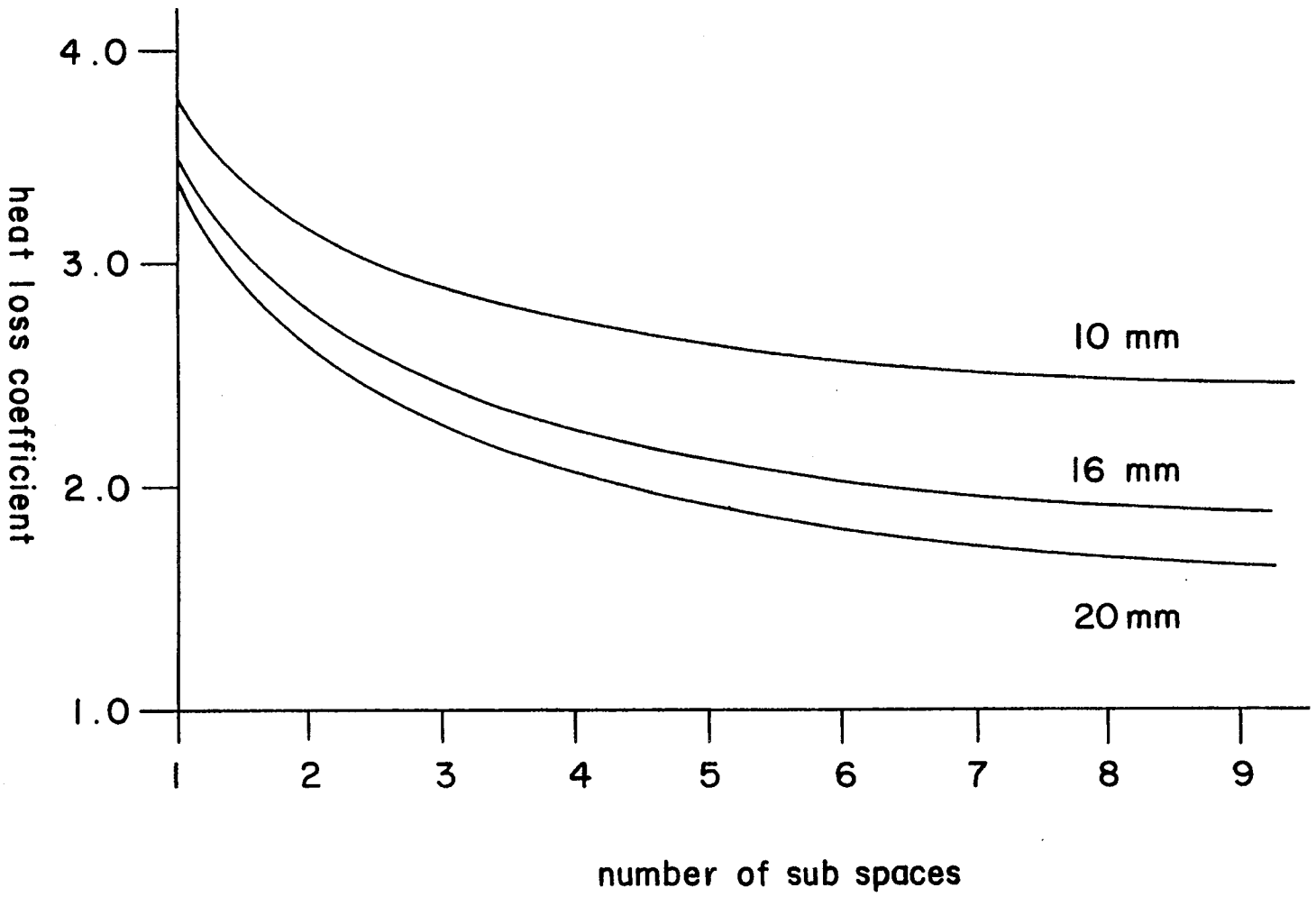
FIG. 2 shows characteristic curves of coefficients of heat loss versus the number of sub-spaces of three panels, formed according to the present invention, having different thicknesses.

Referring to FIG. 2, there are shown three characteristic curves of panels, constructed in accordance with the present invention, having different overall thickness. As seen the higher the number of sub-spaces between the two major surfaces, the lower the coefficient of heat loss, namely, panels having a greater number of sub-spaces, in spite of the fact that the walls enclosing the spaces 12 are made of relatively thin sheet-like material, provide a substantial thermal improvement, as well as improvement in mechanical performance of the panel, as compared with the commonly used, up to three sub-spaces which are formed across such panels. It is recommended to form more than three, e.g., between four and seven such sub-spaces for gaining overall maximal advantage from this structure, for panels having overall thickness of between 15 to 30 mm.

Figure 3:
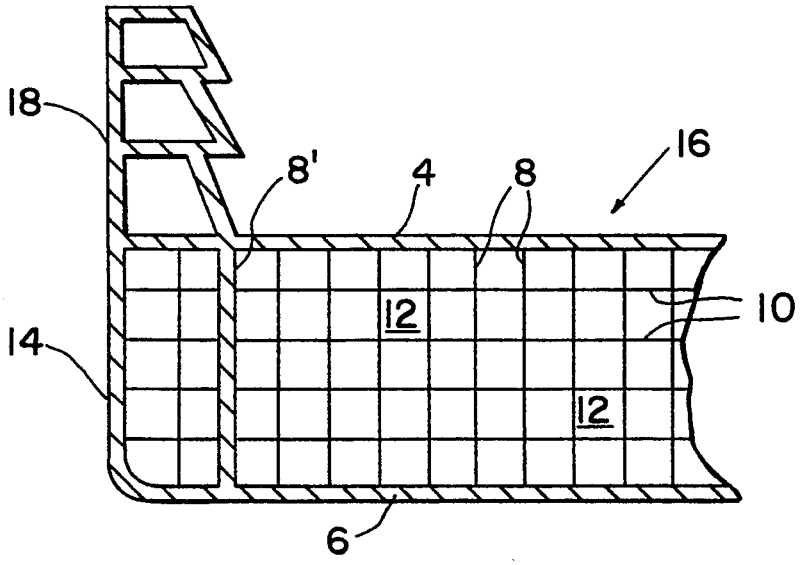
FIG. 3 is a partial cross-sectional view of a panel according to the invention, made with a joining flange.

In FIG. 3 there is shown a panel 16 integrally extruded with a joining flange 18 extending in the direction of extrusion and projecting at an angle from an edge of said panel. For additional strength, the rib 8' extending underneath the inner edge of the flange 18 may be formed with a thickness greater than the ribs 8 and similar to the thickness of surfaces 4 or 6. Likewise, for special purposes where it is required to provide panels suitable to withstanding high pressures, the ribs 8 may be made with a wall thickness of less than 0.2 mm, or alternatively, there may be provided further reinforcement ribs 8' having increased thickness, at precalculated distances along the width of the panel.

Figure 4:
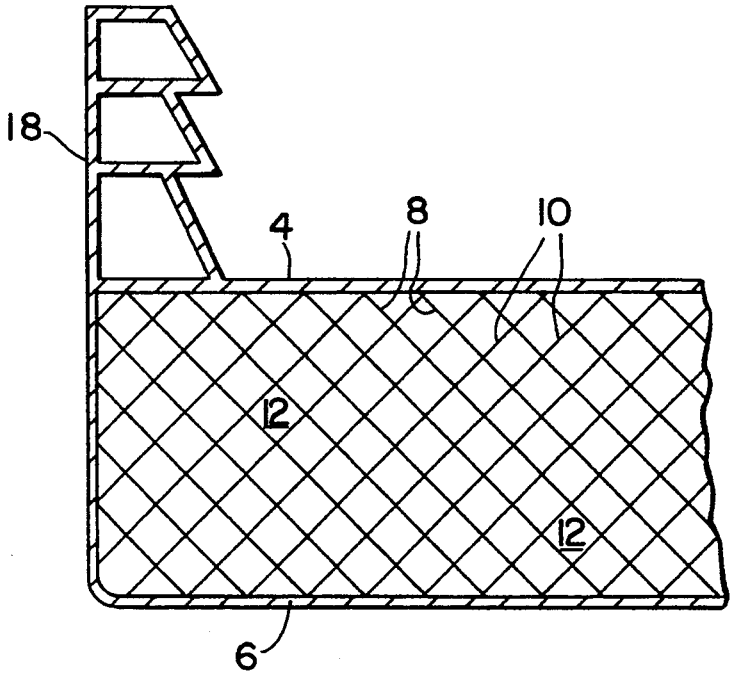
FIG. 4 is a partial cross-sectional view of a further embodiment of the present invention.

In FIG. 4 there is shown a further embodiment of a possible structure according to the present invention, in which the orientation of the panels of the ribs 8 and the surfaces 10 are not substantially perpendicular and respectively, parallel to the planes of the major surfaces 4 and 6, but rather inclined thereto. Also in this configuration as seen, there are provided more than three sub-spaces in between the two major surfaces.

Naturally, structures in which only the ribs 8 or the surfaces 10 are inclined to the parallel major surfaces 4 and 6, could also be utilized.

Also, while the figures show sub-spaces 12, all of which are substantially of the same dimensions, it should be noted that variations in the distances between adjacent surfaces 10, so as to form sub-spaces of increased and diminished sizes in between the two major surfaces, is possible.

Likewise, a panel unit according to the present invention may be formed with sub-spaces of diminished or increased sizes located in the panel portion adjacent to the flanges 18.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An extruded, panel unit for constructional purposes, comprising at least two sheets forming major surfaces interconnected and spaced apart by a plurality of ribs and intermediate surfaces which divide a space defined between said major surfaces into a plurality of sub-spaces, wherein, in cross-section, said major surfaces and said ribs and intermediate surfaces form a truss structure and wherein there are provided more than three sub-spaces across a plane extending substantially normal to and connecting said major surfaces.

2. The panel as claimed in claim 1, wherein walls of said ribs and intermediate surfaces are of a thickness which is at most one third of the thickness of either of the major surfaces.

3. The panel as claimed in claim 1, wherein walls of said ribs and intermediate surfaces are of a thickness less than 0.2 mm.

4. The panel as claimed in claim 1, wherein said ribs and surfaces form, in cross-section, a configuration of squares.

5. The panel as claimed in claim 1, wherein a distance d between ribs and a distance l between surfaces forming a sub-space is such that $d/l \leqq N/2$, where N is a number of sub-spaces between said major surfaces and wherein $N \geqq 4$.

6. The panel as claimed in claim 1, further comprising at least one end wall joining the edges of said major surfaces.

7. The panel as claimed in claim 1, further comprising at least one joining flange extending in a direction of extrusion, said joining flange projecting at an angle from, at or adjacent to, an edge of the panel.

8. The panel as claimed in claim 1, further comprising reinforcing ribs having a thickness greater than the thickness of said ribs.

9. The panel as claimed in claim 1, wherein each subspace is enclosed by ribs and intermediate surfaces.

10. The panel as claimed in claim 1, wherein said ribs and said intermediate surfaces are oblique to said major surfaces.

11. The panel as claimed in claim 1, wherein said ribs are perpendicular to said major surfaces and said intermediate surfaces are parallel to said major surfaces.

12. The panel as claimed in claim 1, wherein said ribs and said intermediate surfaces are oblique to said major surfaces.

13. The panel as claimed in claim 1, wherein said ribs are perpendicular to said major surfaces and said intermediate surfaces are parallel to said major surfaces.

14. An extruded panel unit, comprising:

at least two sheets forming major surfaces;

a plurality of ribs interconnecting the major surfaces, the ribs arranging the major surfaces in a parallel, spaced apart relationship so as to define a space between said major surfaces; and intermediate surfaces which divide the space defined between said major surfaces into a plurality of subspaces, wherein, in a cross-section perpendicular to said major surfaces, said major surfaces and said ribs and intermediate surfaces form a truss structure as a configuration of squares, and wherein more than three sub-spaces are provided across a plane extending substantially normal to and connecting said major surfaces.

* * * * *